United States Patent [19]

Waide

[11] 4,028,990

[45] June 14, 1977

[54] EXPLOSIVELY ACTUATED RELEASE DEVICE FOR CALL BUOYS AND THE LIKE

[75] Inventor: Gene Terry Waide, Gilroy, Calif.

[73] Assignee: Holex Incorporated, Hollister, Calif.

[22] Filed: July 15, 1976

[21] Appl. No.: 705,557

[52] U.S. Cl. ..... 89/1 B; 60/636; 85/DIG. 1

[51] Int. Cl.[2] ..... F42B 3/00

[58] Field of Search ..... 89/1 B; 102/49.5; 60/632, 636, 638; 85/DIG. 1

[56] References Cited

UNITED STATES PATENTS

| | | | |
|---|---|---|---|
| 3,053,131 | 9/1962 | Stott | 89/1 B X |
| 3,084,597 | 4/1963 | Beyer | 60/636 X |
| 3,200,706 | 8/1965 | Kinard | 89/1 B |
| 3,373,656 | 3/1968 | Kriesel | 89/1 B |

*Primary Examiner*—David H. Brown
*Attorney, Agent, or Firm*—Owen, Wickersham & Erickson

[57] ABSTRACT

An explosively actuated device for releasing a tongue bar from a clevised member embracing the tongue bar and having recessed portions aligned with a recessed portion of the tongue bar. A retaining block has a lower end normally in the recessed portions to lock the tongue bar and clevised member together and released therefrom when a cartridge is exploded to produce gases that build up pressure inside the block that moves the block. A retaining bolt secured to the tongue bar extends up inside the block and prevents the block from moving very far and holds it to the tongue bar. There is no fragmentation, and the retention strength is great.

10 Claims, 5 Drawing Figures

FIG. 1
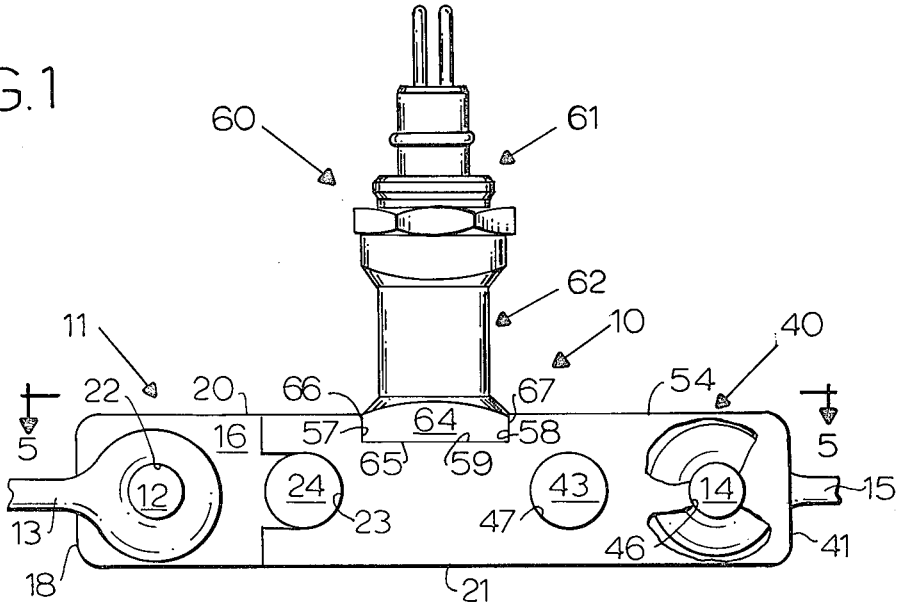
FIG. 2
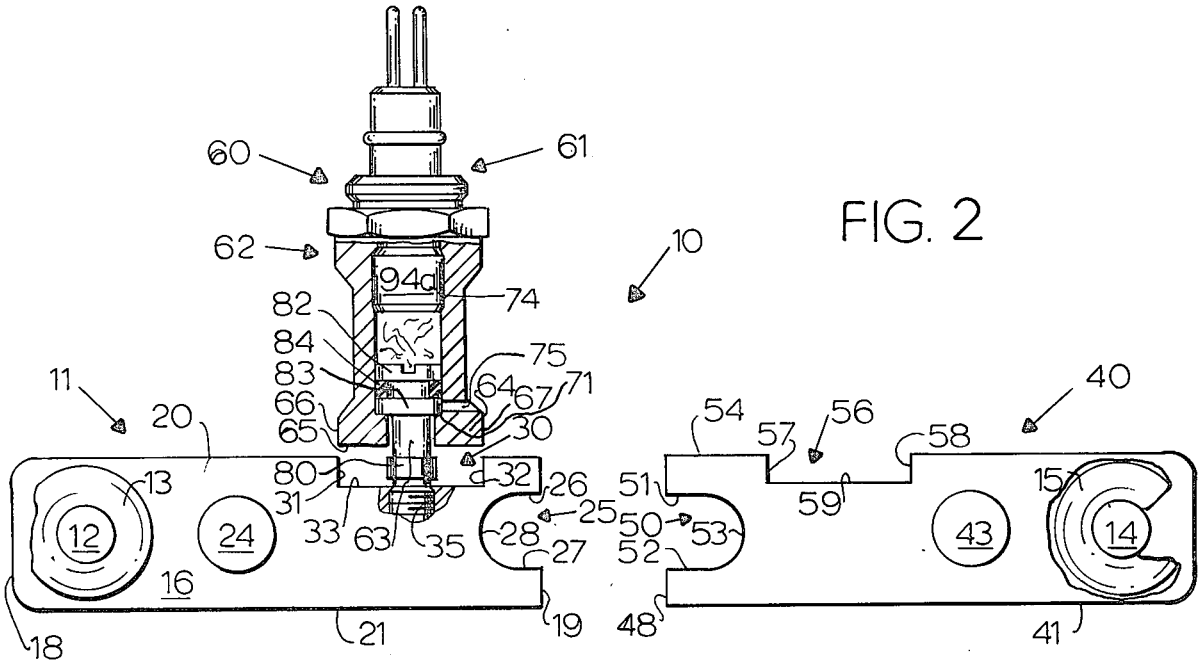
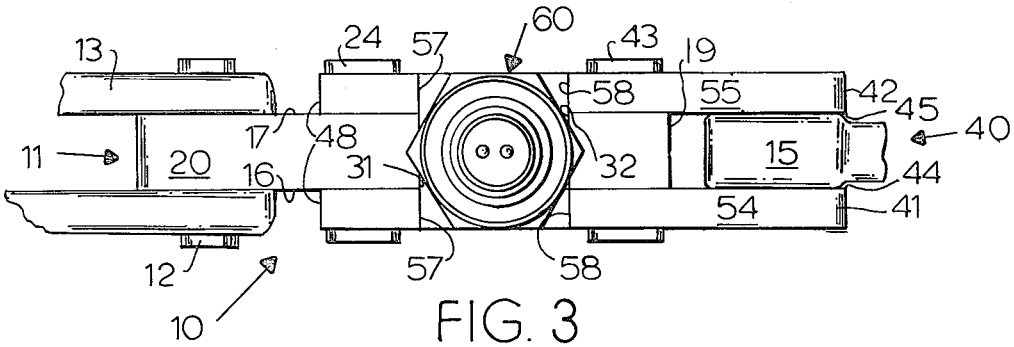
FIG. 3

EXPLOSIVELY ACTUATED RELEASE DEVICE FOR CALL BUOYS AND THE LIKE

BACKGROUND OF THE INVENTION

This invention relates to an improved release device of the type which is explosively actuated. It has particular application as a release device for a call buoy but is also useful for the release of other devices, including release underground or in the air.

One of the objects of the invention is to provide a compact, reliable release device that is operated by an explosive cartridge. It is also important that the device have a large holding strength, that is, be able to resist in its unactuated state a considerable tensile load and that there be a large strength-to-weight ratio.

Some release devices are objectionable in that they tend to fragment when the explosive action occurs, and it is important in the present device that there be no serious danger of flying fragmentation, such as is generally associated with explosive bolts and similar devices that contain high explosives.

In devices of the type heretofore in use there have been difficulties in transportation and other objections due to the use of high explosives. The present device is designed to be operated without some of these high explosives to provide a reliable release device in which there are two separable components and no creation of other loose parts, fragments, contaminants, or of objectonable gases.

As indicated above, one particular use of the present invention is in conjunction with an underwater call buoy, that is, a portable, self-contained assembly consisting of an electronic module, a battery pack, a buoy housing, an explosive release device, a steel cable and a buoy nest. All the devices except the explosive release device are in themselves old. The buoy housing is attached to the buoy nest by the explosive release device, and, in use, the call buoy is installed on the ocean floor at a site that is to be relocated from the ocean surface at a later date. At the time of recall, a command module on board a surface vessel transmits a coded acoustic (or other) signal that is picked up by the call buoy's electronic module. At that time, then, the electronic module applies an electrical pulse to the bridge wire of the explosive cartridge through underwater electrical lead wires and connections that form part of the explosive release device.

When the explosive cartridge is fired, a high pressure gas is generated that is used in the present invention to shear off a retaining flange on a retaining bolt and to force a retaining block up in such a way as to release a clevis forming part of the explosive release device from a tongue end forming another part thereof. The explosive release then enables the clevis and tongue to separate, so that the call buoy can float to the surface, trailing a steel cable which is attached to the buoy nest and which anchors the call buoy to the ocean floor. This cable may be used to provide a guide line enabling divers to swim to the site of the buoy nest.

Whether used in connection with a call buoy or with some other device requiring a similar release, the present invention is particularly designed to avoid fragmentation, loose parts, contaminants, or gases.

It is an object of the invention to cause the explosively-actuated cartridge to remain with one part of the device (e.g., to remain with the call buoy and float to the top with it), and to resist while it is on its site (e.g., the ocean floor) rather considerable tensile forces exerted (e.g., by the call buoy tending to cause it to rise to the surface). It is also important that the device be completely reliable so that when the charge is exploded the device actuates promptly and accurately.

Furthermore, one object of the invention is to provide a structure such that relatively insensitive explosives like those used in rifle bullets can be used instead of high explosives, which product fragments, as has been the case heretofore. As a result, no special care need be taken in shipping and handling devices of this invention, unlike the care of the hazardous prior-art devices.

Also, an object of the invention is to provide a release device that will mate with ordinary chain shackles and eye bolts and can be installed quickly.

SUMMARY OF THE INVENTION

The explosively-actuated release device of the present invention includes in combination a tongue bar and a clevised member that has two arms, one on each side of the tongue bar. The tongue bar has a cylindrical opening through it from one side wall to the other and also has at one end an end wall that has a notch leading into the side walls with straight edges that lead into an inner semicylindrical surface. The clevised member has in each arm a similar notch and a similar cylindrical opening. The device also includes two cylindrical pins, one of which passes through the cylindrical opening of the tongue bar and is in engagement with the notches of the clevised member, while the other one passes through the cylindrical opening in the clevised member and is in engagement with the semicylindrical surface of the notch of the tongue bar.

It will be apparent that nothing so far described holds these two members together against longitudinal forces tending to separate them. Indeed, the pins are used only for aligning the two members.

In order to hold them together, the tongue bar and the clevised member are both provided on one surface with a recess, the recesses of the clevised member being in alignment with that of the tongue bar. In these recesses is normally seated a retaining block which forms part of the explosively-actuated device. The retaining block normally fills all the recessed portions and thereby prevents separation of the tongue bar from the clevised member. The block has a central opening that preferably extends out perpendicularly to the recess and is in line with a locking opening in the tongue bar, through which is secured a retaining bolt which extends up into the central opening of the retaining block. The retaining bolt has a shear flange resting on a shoulder in the central opening of the retaining block. At a spaced distance above this shear flange on the bolt is an O-ring seal with metal retaining members above and below it.

The upper end of the retaining block is connected to a pressure cartridge which includes the firing mechanism and the charge of explosive. The device is so constructed that a lower wall of the pressure cartridge is at or near the top of the central opening of the block, and the result on explosion of the charge is to send gases into the central opening of the block, thereby causing an extremely high load of pressure which acts to move the retaining block and pressure cartridge with respect to the O-ring sealed retaining bolt, and thereby to pull the retaining block out of the recessed openings of the tongue and clevised member.

However, the movement of the retaining block is limited, for when it engages the O-ring seal or the metal members adjacent it which are secured to the retaining bolt, the movement stops. By that time, of course, the retaining block is completely outside the recess.

As a result, witout any fragmentation and without disconnecting the retaining block from the tongue bar, the connection holding the tongue bar and the clevised member together is released. The clevised member is normally retained by the bouy nest, whereas the tongue member normally rises to the surface along with the call buoy to which it is connected.

Of course, it is apparent that the clevised member could be put with the call buoy and the tongue bar with the buoy nest, if desired. Also, the retaining block could be connected to the clevised member instead of the tongue, if that were to be desired. The structure enables the use of a very stout retaining block and a strong retaining bolt as well, so that very large tensile strength can be achieved, as well as exceptionally high strength-to-weight ratios in the device itself.

Other objects, features, and advantages of the present invention will appear from the following description of a preferred embodiment.

BRIEF DESCRIPTION OF THE DRAWINGS

In the drawings:

FIG. 1 is a view in elevation of a release device embodying the principles of the invention.

FIG. 2 is a view of the device of FIG. 1 when separation has been achieved with the cartridge having been exploded.

FIG. 3 is a top plan view of the device of FIG. 1 in its connected position.

DESCRIPTION OF A PREFERRED EMBODIMENT

Figures 4, 5:
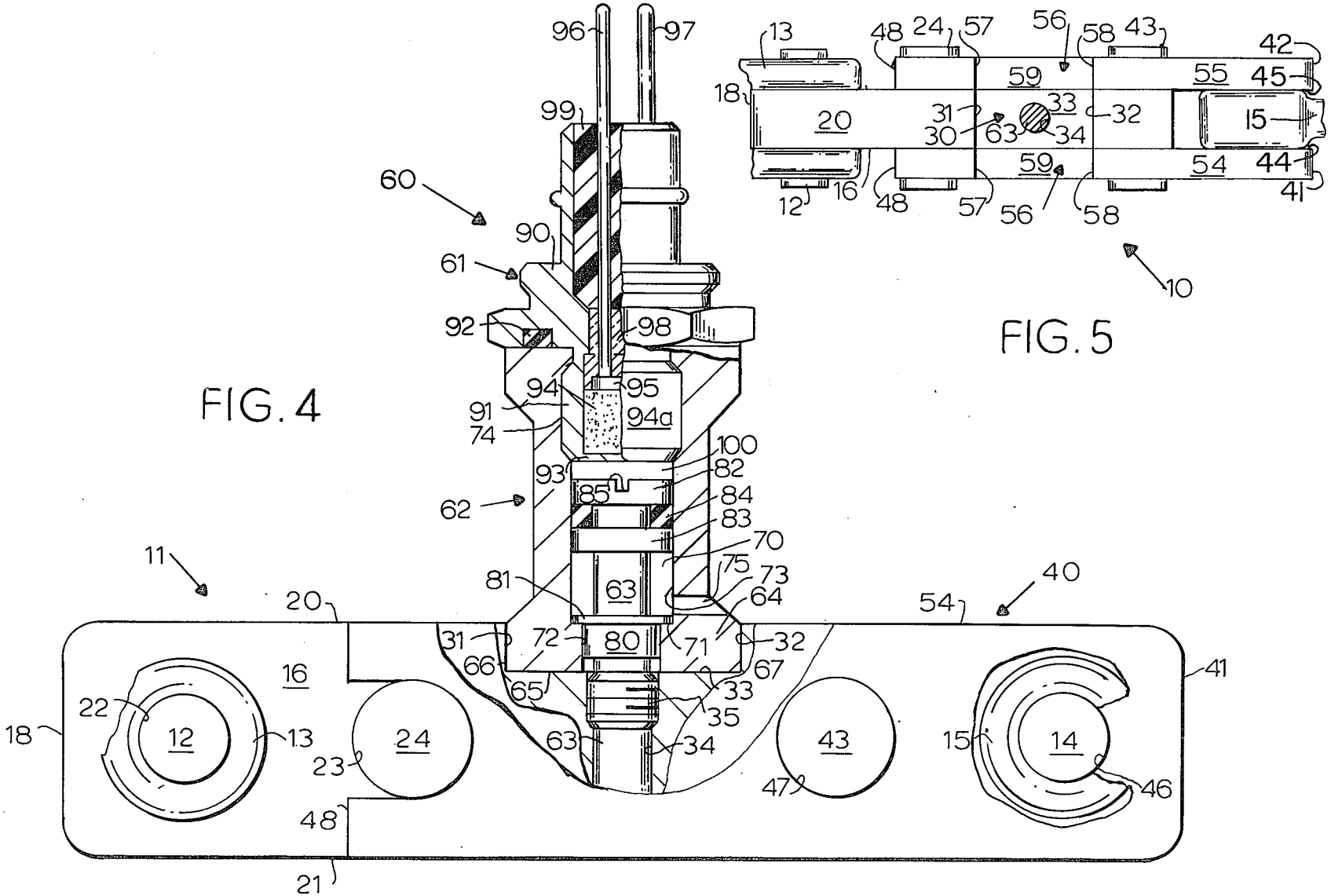
FIG. 4 is an enlarged view of the device of FIG. 1, largely broken away and shown in section.
FIG. 5 is a view taken along the line 5—5 in FIG. 1, with the cartridge removed or in its disengaged position shown in FIG. 2.

In a preferred embodiment, a release device 10 of this invention comprises three basic components, namely: a pair of connection members which may take the form of a tongue bar 11 and a clevised member 40; and an electro-explosive or retaining block assembly 60. For purposes of discussion, it will be assumed that the tongue bar 11 is connected to a secondary or movable body such as a call buoy (not shown) via a pin 12 (FIG. 1) and a connector 13, while the clevised member 40 is connected to a primary or generally stationary body such as a buoy nest (not shown) as via a pin 14 and a connector 15. Of course, they could be connected oppositely. Modifications in structure will be apparent, and also it will be noted that the release device 10 does not have to be used in combination with a call buoy but may be used with other devices where ultimate separation is desirable and where strong retention is required before separation.

The tongue bar 11 is provided with two flat side walls 16 and 17 and is also provided with two end walls 18 and 19 and two edge walls 20 and 21. Two cylindrical openings 22 and 23 extend through from one side wall 16 to the other side wall 17 at desired locations, one opening 22 receiving the connection pin 12, the other opening 23 retaining an aligning pin 24. One end wall 19 is provided with an inwardly-extending notch 25 having straight walls 26 and 27 leading in to a semicylindrical terminal portion 28 (see FIG. 2).

One edge wall 20 is provided with a recess 30 preferably having straight end walls 31 and 32 that are perpendicular to the edge wall 20 and lead in to a recessed surface 33 parallel to the surface of the edge wall 20. A vertical opening 34 (see FIG. 4) is bored through from the center of the recessed surface 33 and preferably extends all the way through the tongue bar 11 down to the other edge wall 21, though that is not necessarily required. At least a portion 35 of the opening 34 is threaded.

The clevised member 40 comprises a pair of arms 41 and 42, which may be connected together at one end, or they may simply be (as shown) separate members joined together by a pin 43, so long as there is a suitable connection. Each arm 41, 42 has an inner wall 44, 45, and these walls 44 and 45 normally lie opposite to and in contact with the side walls 16 and 17 of the tongue bar 11. Two cylindrical openings 46 and 47 extend through each of the two arms 41 and 42, the openings 46 for the connection pin 14 and the openings 47 for the pin 43. An end wall 48 of each of the clevised members is provided with a notch 50 like the notch 25 previously described for the tongue bar, the notch 50 having straight walls 51 and 52 leading in to a semicylindrical opening 53, and it is so related with the cylindrical opening 47 that the device 10 can be assembled with proper alignment, as will be described below. Each arm 41, 42 has an edge wall 54, 55, in each of which is a recess 56 with straight end walls 57 and 58 and a recessed surface 59.

The clevised member 40 and the tongue bar 11 are made so that when the recess 30 of the tongue bar 11 is aligned with the recesses 56 of the clevised member 40, the notches 50 of the clevised member 40 will be in alignment with the cylindrical opening 23 (and the pin 24) of the tongue bar 11, and the notch 25 of the tongue bar 11 will also be aligned with the cylindrical openings 47 (and the pin 43) of the clevised member 40. When the device 10 is assembled the pins 24 and 43 extending through the respective cylindrical openings 24 and 47 aid in obtaining proper alignment, and it should be noted that these pins and the corresponding notches in the tongue and clevis end walls, in cooperaton with the interengagement of the tongue with the clevis, lock the tongue and clevis members against relative movement in any direction except the longitudinal separating direction.

The electro-explosive assembly 60 incorporates a cartridge assembly 61, a retaining block 62, and a retaining bolt 63. The retaining block 62 has a lower end portion 64 which is adapted to fit into the recesses 30 and 56, with a bottom wall 65 to abut upon the recess walls 33 and 59 and end walls 66 and 67 to seat between the two sets of straight walls 31, 57 and 32, 58 leading into the recesses 30 and 56. In this manner, the retaining block 62 normally holds the tongue bar 11 and clevised member 40 together until an explosive charge is fired. The retaining block 62 is secured at its upper end to the cartridge assembly 61 and its exterior shape above the portion 64 is relatively unimportant except insofar as strength is concerned. Interiorly, the retaining block has a central opening 70, which has a shoulder 71 so that there is a lower narrow-diameter portion 72 leading via the shoulder 71 to a wider-diameter upper portion 73. Preferably there is also an outwardly recessed portion 74 as shown in FIG. 2 in which the cartridge member 61 is secured. A bleed or vent opening 75 leads out from the central opening 70 just above the shoulder 71, as described below.

The retaining bolt 63 is threaded into the tongue bar 11 in its locking opening portion 35, and is thereby fastened very securely to it so that it cannot come out. This is to be a substantially permanent connection. The retaining bolt 63 has an aligning portion 80 which fits movably but fairly snugly within the opening portion 72 of the central opening 70. At the upper end of this aligning portion 80 is a shear flange 81 which prevents relative movement between the retaining block 62 and the retaining bolt 63 under normal conditions, but is frangible when an explosion leads to a great increase in pressure in the passage 100, as will be seen. Above the shear flange 81 the narrowed retaining bolt 63 extends up past the bleed opening 75 and above this has a head 82 at its upper end, a washer 83 spaced therebelow and an O-ring seal 84 between the head 82 and the washer 83. The lower end may be threaded into place by inserting a screw driver in a key 85 in the head 82 of the bolt 63. The O-ring seal 84 is to prevent the passage of gases beyond the seal.

As stated before, the upper end of the retaining block 62 is secured to the electro-explosive cartridge 61. This may be done by providing a housing 90 having a keyed portion 91 which is inserted into the block 62 and then turned 90°, for example, or it may be done by threading the electro-explosive cartridge 61 into the retaining block 62. A suitable O-ring seal 92 is provided to prevent gas leakage. The lower end wall 93 of the cartridge, which lies inside the passage 100 of the retaining block 62, is a relatively thin-walled member which is broken open upon explosion of a load 94 which is packed thereabove in a suitable cartridge-receiving cup 94*a*. Above that cup is a prime cup 95 with its bridge wire (not shown, it may be conventional) and with the two leads 96 and 97 going out therefrom through a glass-to-metal seal 98 and through a potting 99 to provide suitable contact pins for connection to the electrical actuating device, not shown here. So far as the structure and actuation of the cartridge 61 are concerned, there is nothing extraordinary; it is like many such well-known devices.

The main points about the cartridge 61 here are (1) the main charge 94 can be a deflagrating propellant like the explosive for rifle bullets, a relatively insensitive explosive; (2) the primer charge 95, which is in contact with a bridgewire (not shown) can be the ignition system for the cartridge 61, rather than using a sensitive high explosive; (3) upon explosion of the main charge 94, the wall 93 is ruptured, and the gas released thereby goes into a chamber 100 just above the bolt head 82. The O-ring seals 84 and 92 keep the gas in that chamber 100.

The gases in the chamber 100 greatly increase the pressure in that chamber and tend to cause movement between the retaining block 62 and the retaining bolt 63. This movement is prevented only by the strength of the shear flange 81, and the shear flange 82 is purposely designed to break when sufficient pressure is exerted, the pressure being calculated as well below that set up by the explosive device. Thus, the forces break the shear flange 81, and the block 62 moves up out of the recsses 30 and 56, moving up until the shoulder 71 abuts the washer 83, which lies just below the O-ring seal 84. The bleed opening 75 enables venting of air, water or other fluids that may be trapped in the chamber 70, doing so during the actuation movement shown in FIG. 2.

The movement of the retaining block 62 is in excess of that required to retract the retaining block 62 completely from the recesses 30 and 56. At the same time, the captured gases in the chamber 100 hold the retaining block 62 in the retracted position once this movement has been completed, and the forces are sufficiently released so that there is no further movement. Moreover, no fragmentation occurs whatever, due to the stoutnes of the parts and the purposely created weaknesses at the desired places (e.g., the flange 81), so that the retaining bolt 63 is held in place, and the retaining block 62 is held by the washer 83, the bolt head 82, and the O-ring seal 84 acting in cooperation with each other. In fact, the O-ring 84 tends to cushion the blow of the outwardly moving retaining block 62 as it hits the washer 83, thereby helping to assure that fragmentation will not occur. Thus, the cartridge 61 and the retaining block 62 remain connected to the tongue bar 11 by the retaining bolt 63. The tongue bar 11, however, is separated from the clevised member 40 as soon as the retaining block 62 is retracted from the recesses 30 and 56 because, as has been stated earlier, the tongue bar 11 is connected to a call buoy or to some other device in which there already is exerted a considerable force, which may be up to 50,000 psi tensile strength, tending to cause separation of the tongue bar 11 from the clevised member 40. It will be apparent that the retaining block 62 and retaining bolt 63 can be made very strong, so that practically any strength can be designed into the unit. Yet it can be relatively small and relatively inexpensive, as well as quite simple in form. If the release device is to be used for a call buoy or in other locations where corrosion is likely, at least the tongue and clevised member should be made from a material that will resist such corrosion. For example, stainless steel or a heavy, strong plastic material may be used.

To those skilled in the art to which this invention relates, many changes in construction and widely differing embodiments and applications of the invention will suggest themselves without departing from the spirit and scope of the invention. For example, in place of the tongue and clevis with the pins and slots, other devices that would lock two adjacent bar members together except with respect to longitudinal movement may be used, provided it is sufficiently strong. Similarly, the retaining block can have other suitable interengaging means with the connection member edges, to prevent relative longitudinal movement. The aligned recesses in the member edges are only one preferred structure for this purpose. The disclosures and the description herein are purely illustrative and are not intended to be in any sense limiting.

I claim:

1. An explosively actuated release device, including in combination:

a tongue bar, a clevised member embracing the tongue bar on two of its sides, said bar and said member having at least one edge surface of each aligned on substantially a common plane, each said surface having a recess therein, the recesses being aligned, a retaining block having a lower end portion normally in said recesses and holding said tongue bar and said clevised member against relative longitudinal movement, said block having a stepped opening in and extending beyond said lower end portion, said opening having a lower shoulder, means associated with the tongue bar and the clevised member for preventing relative lateral movement and relative rotational movement of the tongue bar and clevised member, a retaining bolt secured to said tongue bar and extending into said opening and having a shear flange resting on said shoulder and having an enlarged head thereabove, a cartridge extending into the end of said stepped opening distal from said lower end portion and sealed to said block and containing an explosive load and an initiator and having a rupturable end in said stepped opening, explosion of said load resulting in rupture of said rupturable end and the building up of gas pressure in said stepped opening, thereby causing said flange to be sheared off and said block to move away from said tongue bar and said clevised member, so that it is fully retracted from said recesses, said enlarged head thereafter engaging said shoulder to stop movement of said block, so that said bolt holds said block to said tongue bar after separation of said tongue.

2. The release device of claim 1 wherein said means associated with the tongue bar and the clevised member comprises: both said tongue bar and said clevised member having a notched end and a through opening, the notch of said bar being aligned with said through opening of said clevised member when said recessed portions are aligned and the notch of said clevised member then being aligned with said through opening of said tongue bar, and a pin in each said through opening engaging the notch of the other member.

3. The release device of claim 1 wherein said block has a vent opening perpendicular to said stepped opening lying just above said shoulder and said bolt carries sealing means for sealing against said stepped opening, said sealing means before separation intervening between said vent opening and said cartridge and after separation being positioned adjacent to the vent opening and the shoulder.

4. An explosively actuated release device, including in combination:

a tongue bar having two flat side walls, at least one edge wall perpendicular to said side walls, and at least one end wall perpendicular to said edge wall and to said side walls having a first notch with straight walls leading into said side walls and terminating in a first semicylindrical surface, said bar having a first cylindrical opening therethrough from one side wall to the other, said one edge wall having a first recessed portion axially in between said notch and said first opening and provided with edges leading into said side walls and terminating at a recessed wall from which a locking opening leads down generally parallel to said end wall into said bar, a clevised member having a pair of arms with flat side walls, one lying on each side of said tongue bar and normally in contact with the side walls of said tongue bar and terminating in end walls that have parallel second and third notches with straight walls leading into said side walls and terminating in second and third semicylindrical surfaces, said clevised member's arms having, respectively, second and third aligned cylindrical openings therethrough, each of said arms having an edge wall having, respectively, second and third recessed portions with straight edges terminating at a recessed wall, said first notch being aligned with said second and third aligned cylindrical openings and a first cylindrical pin extending through them, said second and third notches being aligned with said first cylindrical opening and a second cylindrical pin extending through them, said first, second and third recessed portions all being aligned with each other, a retaining block having a lower end filling said first, second, and third recessed portions and thereby holding said tongue bar and clevised member together against separation otherwise possible, said block having a central opening extending therethrough in line with said locking opening, from said recessed wall through a distal end of said block, said central opening being stepped to provide a lower shoulder, a pressure cartridge having a body extending into said block's central opening and sealed to the distal end of said block and containing an explosive load having an initiator, the end of said body in said central opening being rupturable so that when said load is exploded, the gases therefrom enter said central opening of said block, a retaining bolt in said central opening extending into said tongue bar's locking opening and secured there to said tongue bar, said retaining bolt having a shear flange resting on said shoulder and having means retaining an O-ring seal spaced thereabove, explosion of said load causing a great increase in pressure in said central opening, resulting in movement of said block and body relative to said tongue bar, said clevised member, and said retaining bolt, shearing off said shear flange, and said movement stopping when the shoulder of said block's central opening engages said O-ring seal, the movement of said block carrying it completely out of said recessed opening and releasing the connection between said tongue bar and said clevised member enabling them to move apart from each other.

5. An explosively actuated release device, including in combination:

a first connection member having means for attachment to a primary body, a second connection member having means for attachment to a secondary body which is eventually to be removed from proximity to the primary body, means providing a separating force urging said primary and secondary bodies apart, at least in the vicinity of the primary body, said first and second connection members being aligned and longitudinally overlapped through part of their lengths, in side-by-side relationship, and located in between the primary and secondary bodies, means associated with the first and second connection members for preventing relative lateral movement of the two members, and for preventing relative rotational movement of the two members, a retaining block positioned at corresponding adjacent outer edges of the two connection members, and means associated with the retaining block and with said adjacent outer edges for interengaging the block with both edges to prevent relative longitudinal movement of the two connection members, means normally holding the retaining block in the interengaged position, explosively actuated means for driving the retaining block outwardly away from the connection member edges when separation of the primary and secondary bodies is desired, to thereby separate the interengaging means by moving the retaining block to a disengaged position, and means connecting the retaining block, when disengaged, to one of the connection members.

6. The release device of claim 5 wherein the interengaging means comprises aligned recesses in said corresponding outer edges of the connecting members, and a complementarily shaped end portion on the retaining block, normally held in the aligned recesses to prevent the separation of the members.

7. The release device of claim 5 wherein the means connecting the retaining block includes a bolt affixed to and extending perpendicularly from said one connection member, and a longitudinal bore extending into the retaining block from the end having the interengaging means, including a shoulder and a larger diameter portion spaced from said end, said bolt extending into the bore and being slidable with respect thereto and including a head within the large diameter portion normally spaced from the shoulder, whereby upon actuation of said explosively actuated means, the bolt head interacts with the bore shoulder to limit movement of the retaining block away from said one connection member.

8. The release device of claim 7 wherein said means normally holding the retaining block comprises a shear flange normally affixed to the bolt within said larger diameter portion of the bore, adjacent to and in engagement with the bore shoulder, said shear flange being frangible upon actuation of the explosively actuated means.

9. The release device of claim 7 wherein said explosively actuated means comprises means adjacent to the bolt head sealing the end of the bolt against said larger diameter portion of the bore, a bleed hole connecting the larger diameter portion with the exterior of the retaining block at a position adjacent to the shoulder, and an explosive cartridge assembly at the outer end of the retaining block and having a rupturable end adjacent to the outer end of said bore, whereby an expansible chamber is formed between the cartridge assembly and the bolt head, operable to drive the retaining block outwardly with respect to the bolt head into its disengaged position when the explosive cartridge assembly is actuated to fracture said rupturable end and build up gas pressure in the expansible chamber.

10. The release device of claim 9 wherein said sealing means comprises an O-ring seated on the bolt adjacent to the head and in engagement with the larger diameter portion of the bore.

* * * * *